US005803069A

United States Patent [19]

Schreiber

[11] Patent Number: 5,803,069

[45] Date of Patent: Sep. 8, 1998

[54] ADJUSTABLE QUIVER

[76] Inventor: John D. Schreiber, 10923 Wattsburg Rd., Wattsburg, Pa. 16442-9724

[21] Appl. No.: 939,765

[22] Filed: Sep. 29, 1997

[51] Int. Cl.[6] ..... F41B 5/06

[52] U.S. Cl. ..... 124/86; 124/25.7; 224/916

[58] Field of Search ..... 124/25.5, 25.7, 124/86; 224/916

[56] References Cited

U.S. PATENT DOCUMENTS

| | | | |
|---|---|---|---|
| 3,561,651 | 2/1971 | Ramsey | 124/25.5 X |
| 3,716,174 | 2/1973 | Ehlert | 124/25.7 X |
| 4,073,328 | 2/1978 | Franklin | 206/315.11 |
| 4,156,496 | 5/1979 | Stinson | 124/25.7 |
| 5,265,584 | 11/1993 | Judson | 124/86 |
| 5,452,703 | 9/1995 | Bateman | 124/86 |

FOREIGN PATENT DOCUMENTS

| | | | |
|---|---|---|---|
| 752176 | 2/1967 | Canada | 124/25.5 |

*Primary Examiner*—John A. Ricci

[57] ABSTRACT

An improved Adjustable Quiver which will house arrows having different size shafts and various styles of arrowheads is disclosed. The Quiver is comprised of an elongated frame, on one end of which is attached an arrowhead receiving housing with an adjustable pressure plate, and on the other end of which is attached a shaft holder base assembly.

8 Claims, 8 Drawing Sheets

ADJUSTABLE QUIVER

BACKGROUND OF THE INVENTION a. Field of the Invention

This invention relates to an improved adjustable quiver for holding an archer's arrows in readiness for use, especially during hunting.

b. Description of the Prior Art

In the sport of archery, or archery hunting, the archer is generally limited to having one arrow at a time in a position in the bow in which it is ready to be fired. It is very desirable to have additional arrows quickly available to replace an arrow which has been fired. The quiver is a device for holding extra arrows until they are needed by the archer. Quivers are also useful for holding arrows while the archer is in transit to or from the site where the bow will be shot, or while the bow and arrows are in storage between uses.

At one time, quivers were little more than tube-shaped receptacles with open tops into which the arrows could be placed until needed. A strap on the quiver enabled it to be slung over the archer's shoulder and carried about, with the arrows in easy reach. While functional, this type of quiver design did little to protect the arrows from damage caused by being jostled together in the confined space as the archer moved about. Of particular concern is damage to the arrowhead whose blades must be kept razor sharp for hunting. The feathers, or fletching, on the opposite end of the arrow are also susceptible to damage from movement in this type of quiver.

The drawbacks associated with the simple open-tube quiver have led to the development of other types of quiver which securely and independently hold each arrow in a spaced-apart relation to each other to prevent the arrows from being jostled together as the quiver moves. This type of quiver generally relies upon an elongated base member having one or more shaft holders which are made of a resilient material having a plurality of openings, each of which can snugly grip the shaft of an arrow. The elongated base member can be secured to the bow by a bracket or some other means, without affecting the functionality of the bow, so that the bow and quiver function, in effect, as a single integral unit. Each arrow will be securely held in place by the shaft holder(s) until removal is desired, at which time the necessary force can be supplied by the archer to dislodge the arrow from the opening in the shaft holder(s).

Although this type of quiver is an improvement over the open-tube design, it still leaves the arrowheads exposed and unprotected. This not only renders the arrowheads susceptible to being damaged as the archer moves about, often through rough terrain, but it also exposes the archer to the proximity of razor sharp blades which could inadvertently cause injury.

Thus, it has long been recognized that elongated base member quivers can be improved by providing an arrowhead housing which will substantially surround the arrowhead when the arrow is engaged in the shaft holder(s).

Heretofore, this type of quiver design has followed two paths, neither of which is free from problems. If the quiver has only one shaft holder, then the arrowhead housing must contain some type of material into which the arrowhead can be inserted and held in place. Most commonly, a material such as styrofoam is used. When the arrowhead is inserted into the styrofoam packing in the arrowhead housing, and the shaft is pressed into the shaft holder, the arrow will be securely held in the quiver. The arrow is removed by reversing these steps, first dislodging the arrow shaft from the shaft holder and then withdrawing the arrowhead from the packing material in the arrowhead housing. Although this type of design has proven to be workable, it suffers from the deterioration of the styrofoam or other packing material in the arrowhead housing caused by the repeated insertion and withdrawal of arrowheads. Over time, the packing material wears away to the point that the arrowhead is no longer securely held in the arrowhead housing. The point on the arrow shaft gripped by the shaft holder can then act as a pivot, allowing the arrowhead to move about within the arrowhead housing. Yet another disadvantage of using a packing material insert in the arrowhead housing becomes apparent with the newer types of arrowhead. These newer arrowheads, unlike traditional broadhead arrows, with their fixed, razor sharp blades, use streamlined arrow tips with pivoting blades folded forward to a concealed position within the arrow tip itself. In this new type of arrowhead the folded blades open upon impact with the target exposing the cutting edges. The much smaller profile which this type of arrowhead presents during flight improves the stability and accuracy of the arrow's flight, and it can be anticipated that this type of arrowhead will enjoy increased popularity in the future. Elongated frame quivers with packing material inserts in their arrowhead housings, however, do not do a good job of holding this newer type of arrowhead securely. Furthermore the risk of a premature opening of the arrowhead when it is being inserted into the packing material presents an annoyance and hazard.

To avoid the problem of deterioration of the packing material in the arrowhead housing, a second approach taken in this kind of quiver has been to use a plurality (usually two) of spaced-apart shaft holders. In this type of design, the arrowhead housing is hollow and merely acts as a shield around the arrowhead. No packing material within the arrowhead housing is required in which to embed the arrowhead because the presence of two shaft holders gripping the arrow, in two separate locations on the frame, prevents the development of a pivoting point and keeps the arrowhead from moving around within the arrowhead housing. A good example of this type of design can be seen at Judson, U.S. Pat. No. 5,265,584. Although this type of quiver avoids the problems associated with the use of packing material inserts within the arrowhead housing, it does so at the expense of now having to use two shaft holders, with each arrow thereby gripped in two places. This makes the removal of arrows from the quiver a more awkward procedure.

Accordingly, it is a purpose of the present invention to disclose a quiver which requires only one shaft holder, but which is nevertheless able to securely hold an arrow, including the arrowhead, within an arrowhead housing, without the need for styrofoam or any other packing material being placed in the arrowhead in which to embed the arrowhead. It is a further object of this invention to provide a quiver with adjustment means whereby arrows with different shaft sizes can be conveniently accommodated by the quiver.

DESCRIPTION OF THE PREFERRED EMBODIMENT

Figure 1:
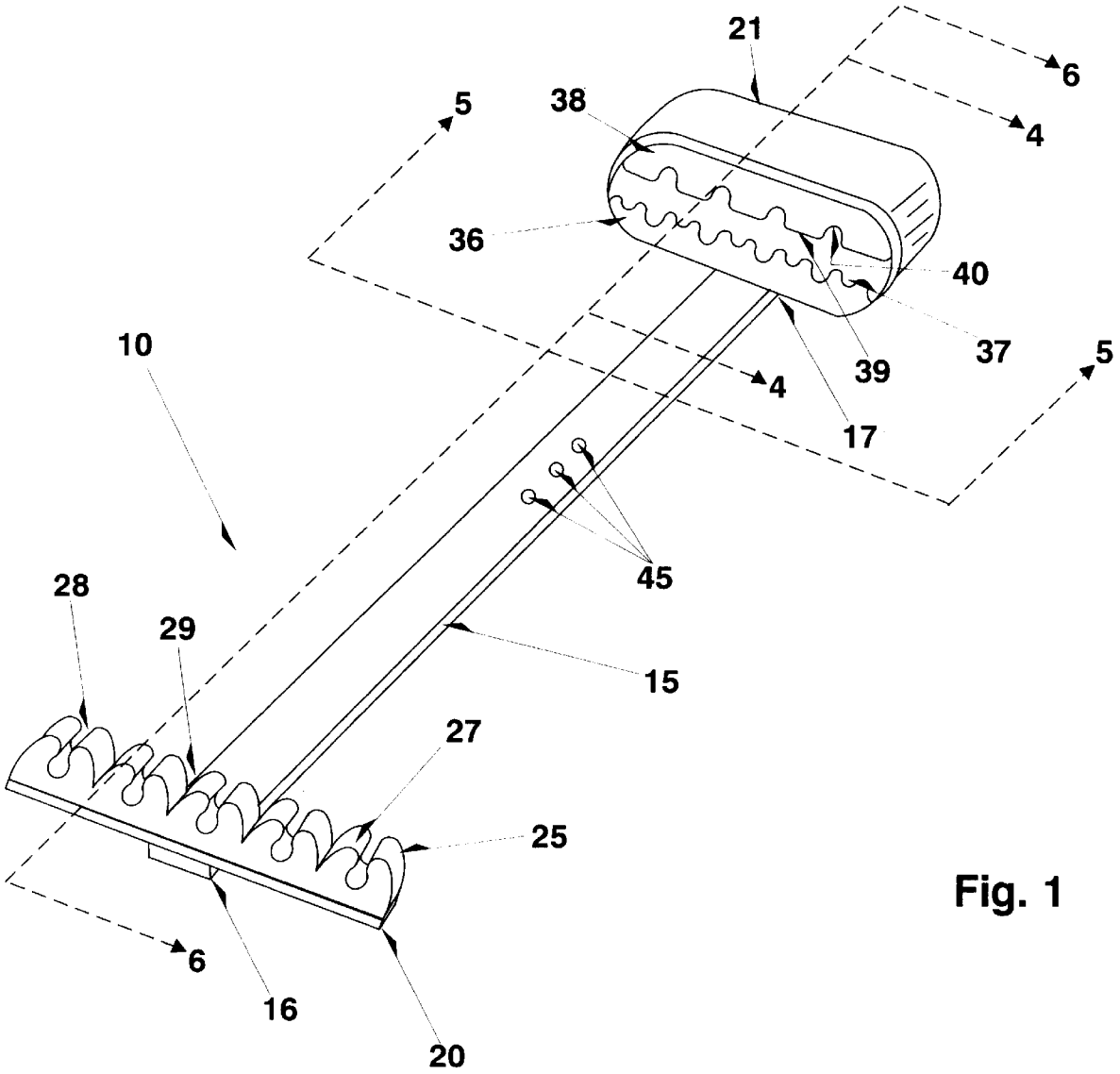
FIG. 1 is a perspective view of the invention.
Figure 2:
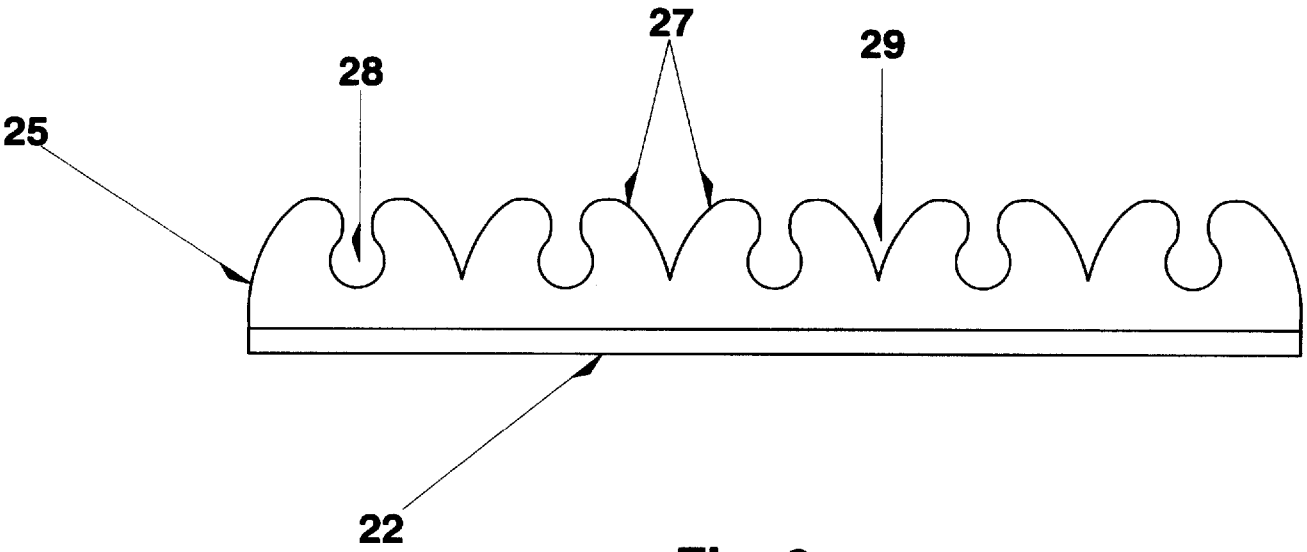
FIG. 2 is an elevation view of the flexible shaft grip bar of the invention.
Figure 3:
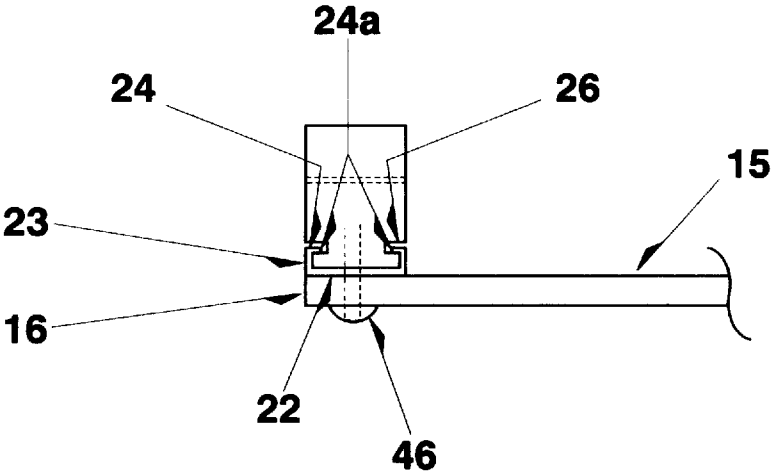
FIG. 3 is a side elevation closeup view of an end of the frame of the invention and the attachment of the shaft grip base.
Figure 4:
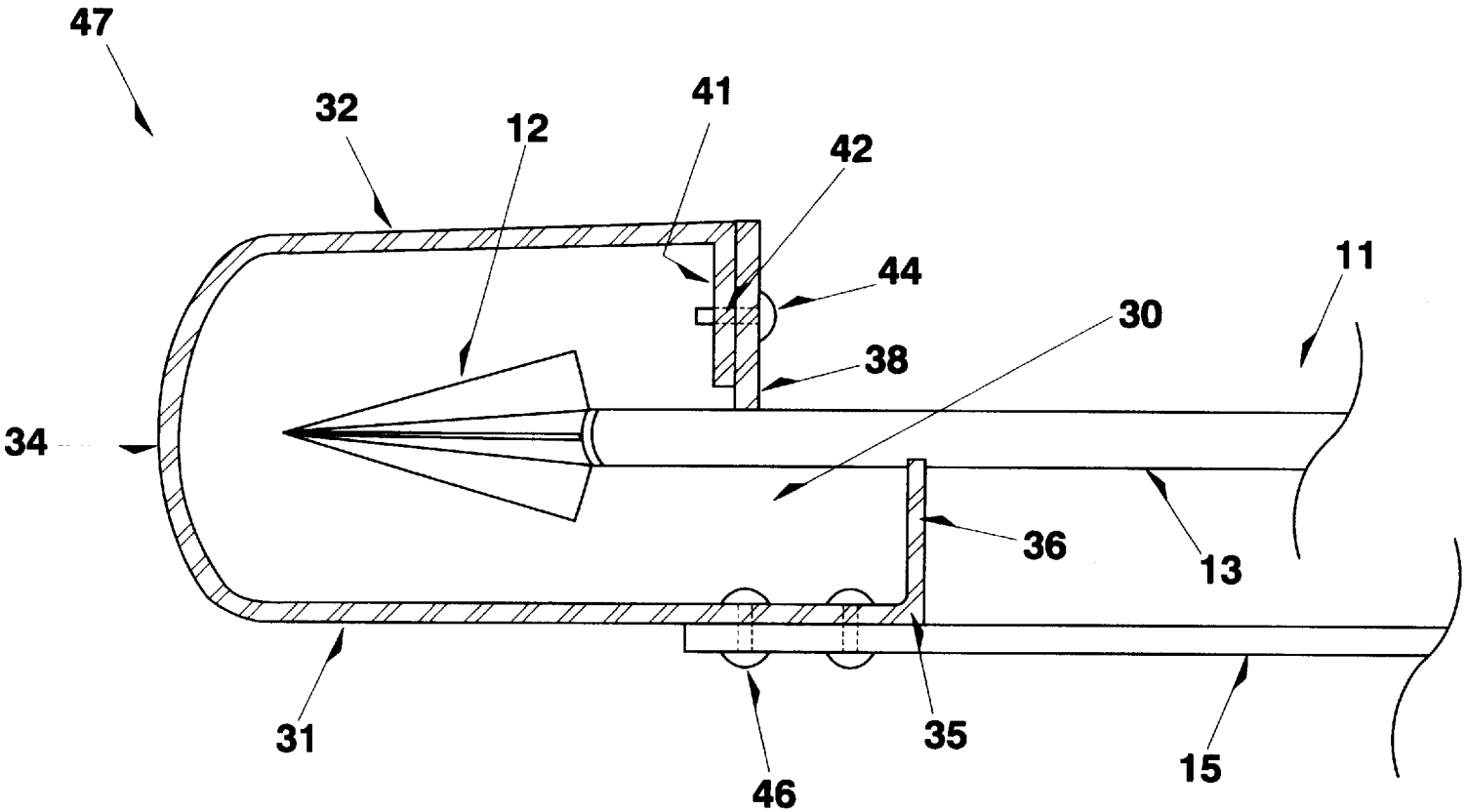
FIG. 4 is a sectional closeup view along line 4—4 showing the arrowhead housing end of the invention and including an arrow shown in place as during use.
Figure 5:
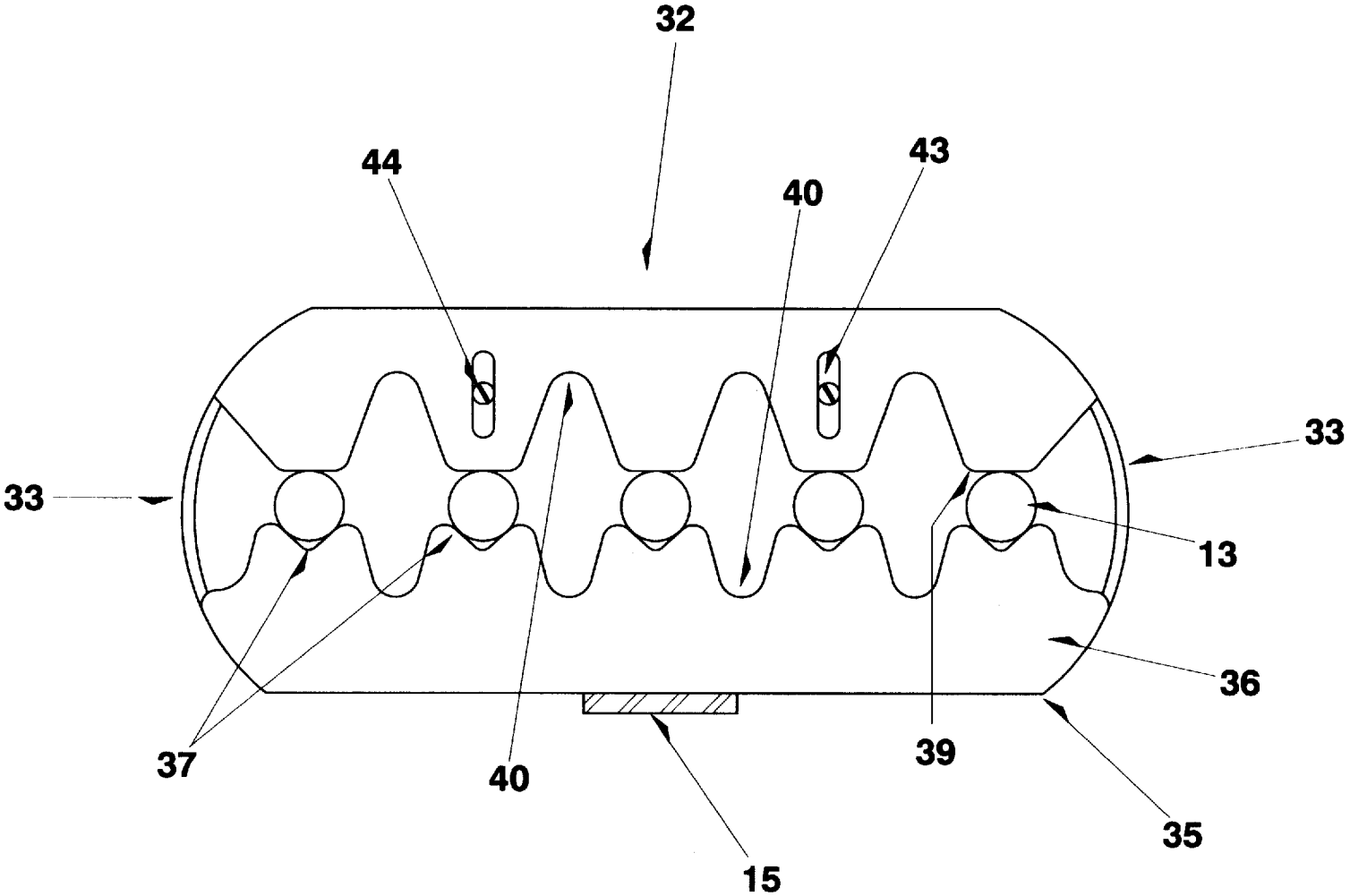
FIG. 5 is a sectional view along line 5—5 showing the pressure bar and shaft rest bar and including arrow shafts shown in place as during use.
Figure 6:
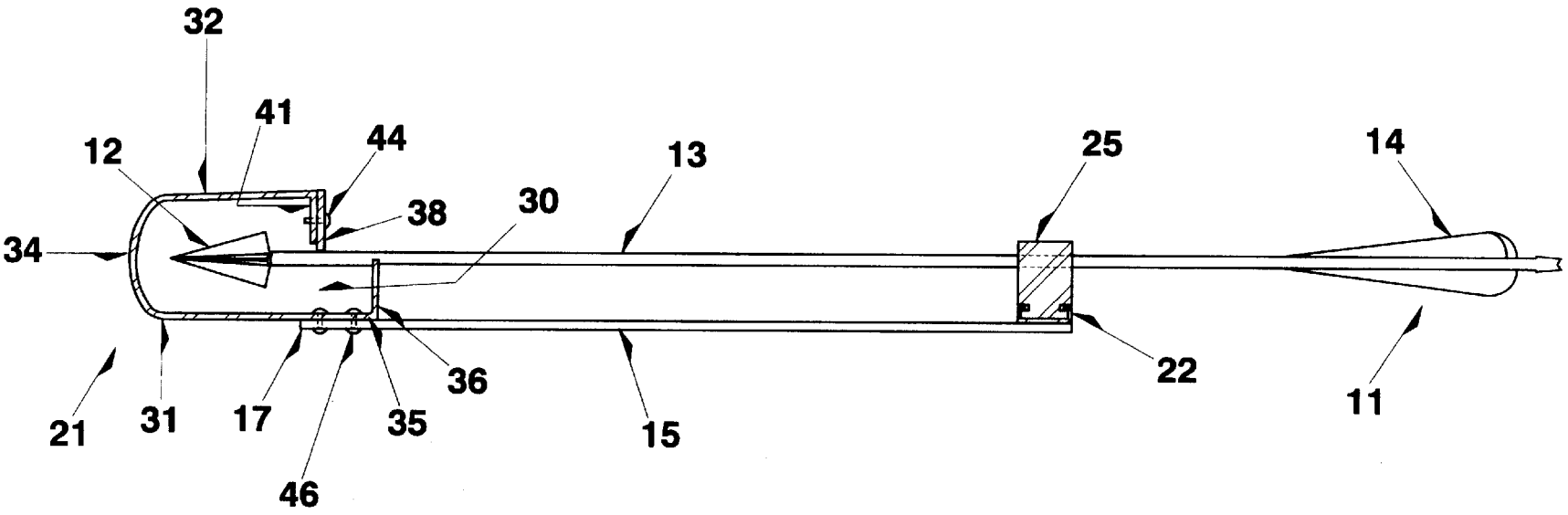
FIG. 6 is a sectional view along line 6—6, showing the frame of the invention and including an arrow shown in place as during use.

A quiver of the present invention is indicated generally by numeral 10 in FIG. 1. The quiver includes a lightweight elongated frame 15 having a shaft end 16 and an arrowhead end 17. A shaft holder assembly 20 is fixedly attached to the shaft end 16 of the frame 15, and an arrowhead receiving assembly 21 is fixedly attached to the arrowhead end 17 of the frame 15. The quiver 10 is mounted on a bow (not shown) by means of a conventional bracket (not shown). The quiver 10 is useful for holding one or more arrows 11, each with an arrowhead 12, a shaft 13, and fletching 14.

In the preferred embodiment, the frame 15 is made of strong, but lightweight material, such as aluminum.

The shaft holder assembly 20, comprising a shaft grip base 22 and a flexible shaft grip bar 25, is secured at the shaft end 16 of the frame 15. The shaft holder assembly 20 is securely attached to the frame 15 by rivets 46 or some other attachment means in a spacially fixed position which is perpendicular to the longitudinal axis of the frame 15. The shaft grip base 25 has opposing longitudinal flanges 23 bent inwardly at right angles to form opposing tongues 24, the whole thereby defining a set of rails 24*a* onto which the flexible shaft grip bar 25 can be inserted.

The flexible shaft grip bar 25 is a body of flexible, resilient material having longitudinal grooves 26 corresponding to the tongues 24 in the shaft grip base 22 allowing the shaft grip bar 25 to be slid snugly into place held by the rails 24*a* of the shaft grip base 22. The shaft grip bar 25 has a plurality of flexible shaft tabs 27 which generally define shaft apertures 28. The size and spacing of the shaft tabs 27 is selected based upon the size of shaft 13 of the arrow 11 which the quiver 10 is to hold. In the preferred embodiment, it can be seen that the shaft tabs 27 are slightly angled toward the center of the apertures 28, thereby partially enclosing the apertures 28 and ensuring a secure grip on the shaft 13 when it is inserted into an aperture 28. V-shaped cutouts 29 between the shaft tabs 27 allow additional flexibility so that it is easier to insert or remove the shaft 13. This feature of the quiver 10 is well known from the prior art and need not be discussed in further detail.

The arrowhead housing assembly 21 includes an arrowhead housing 47, which is a generally cup-shaped receptacle having an open end 30, a closed end 34, a back 31, a front 32, and two sides 33. The arrowhead housing assembly 21 is securely attached to the arrowhead end 17 of the frame 15 by rivets 46 or some other attachment means and is positioned so that the plane defined by the open end 30 faces toward the shaft holder assembly 20 and is perpendicular to the longitudinal axis of the frame 15. The back 31 of the arrowhead housing 47 projects beyond the open end 30, forming a shaft rest bar base 35 which has a perpendicular extension at its end forming a shaft rest bar 36. The shaft rest bar 36 contains notches 37 which correspond in number and alignment to the apertures 28 in the shaft grip bar 25, separated by curved indentations 40.

It can thus be seen that arrows 11 can be placed in the quiver 10 so that each arrowhead 12 is within the arrowhead housing 47, with one point on the arrow's shaft 13 resting in a notch 37 of the shaft rest bar 36, and another point further toward the fletching 14 inserted in and gripped by the corresponding aperture 28 in the shaft grip bar 25.

In such position, the arrows 11 will be parallel with the longitudinal axis of the frame 15, with the arrowheads 12 safely protected within the arrowhead housing 47.

There only remains to be described the means by which the arrows 11 are secured near their arrowheads 12 to prevent any pivoting action about the shaft grip bar 25, as described earlier. In the preferred embodiment this is accomplished by use of an adjustable pressure bar 38. The adjustable pressure bar 38 is preferably made of a rigid material and contains a plurality of flat pressure seats 39 corresponding in number to the apertures 28 in the shaft grip bar 25 and the notches 37 in the shaft rest bar 36. Curved indentations 40 are cut into the adjustable pressure bar 38 between the flat pressure seats 39. In the preferred embodiment, two adjustment slots 43 are also cut into the adjustable pressure bar 38.

The arrowhead housing 47 has a backup plate 41 extending perpendicularly from its front 32 along the plane defined by the open end 30 of the arrowhead housing 47. The backup plate 41 has two tapped screw holes 42 spaced to correspond with the adjustment slots 43 in the adjustable pressure bar 38. When adjustment screws 44 are passed through the adjustment slots 43 in the adjustable pressure bar 38 and into the tapped screw holes 42 of the backup plate 41, it can be seen that the adjustable pressure bar 38 can be easily moved up or down with respect to the shaft rest bar 36 of the arrowhead housing 47 and then fixed by tightening the adjustment screws 44 when the pressure bar 38 is in the desired position.

The action of the pressure bar 38 as a means to secure arrows 11 in the quiver 10 should thus now be easy to visualize. The pressure bar 38 is loosened and moved to its most open position. Arrows 11 are placed in the quiver 10 by, for each arrow, first inserting the arrowhead 12 into the arrowhead housing 47, next guiding the shaft 13 of the arrow 11 into a notch 37 of the shaft rest bar 36, then inserting the shaft 13 into the corresponding aperture 28 in the grip bar 25. Once that has been accomplished for each arrow 11, the pressure bar 38 is moved toward the shaft rest bar 36 until the flat pressure seats 39 make contact with the shafts 13 of the arrows with sufficient force to keep the shafts 13 tightly pushed into the notches 37. This force, coupled with the grip on the arrows 11 at the shaft grip bar 25, ensures that there will be no pivoting action and that the arrows 11 will be securely held in place as the quiver is moved around. The pressure bar 38 should be adjusted so that it provides sufficient force to hold the arrows 11 securely, without being so excessive as to permanently deform the shafts 13 of the arrows 11 or to overcome the gripping action of the shaft grip bar 25. Once the proper position of the pressure bar 38 is found, the adjustment screws 44 can be tightened, locking it in place.

It should be emphasized that the positioning of the pressure bar 38 does not need to be repeated every time the quiver 10 is used. Once the pressure bar 38 has been positioned and tightened in place the quiver 10 is ready to be used indefinitely for any arrows 11 of the same diameter shaft 13, with holding pressure imparted through the pressure bar 38 as the shaft 13 is pressed into an aperture 28. It is only when arrows 11 of a different shaft diameter are desired to be stored in the quiver 10 that a readjustment must be done.

The adjustment feature of the pressure bar 38 has several advantages. First, it allows the user to select the most desirable amount of pressure within a workable range. Some users may prefer increased pressure to more securely seat the arrows 11 at the expense of making it more difficult to insert or release the arrows 11. Others may well prefer that pressure be reduced to a minimum. Secondly, the adjustability feature makes it easy for the quiver 10 to secure arrows 11 of different shaft diameters. While the shaft grip bar 25 may have to be changed to one with different size apertures 28 if an arrow 11 with a significantly different diameter of shaft 13 is used, the combination of the notches 37 in the shaft rest bar 36 and the flat pressure seats 39 in the pressure bar 38 can perform satisfactorily over a wide range of diameters.

The overall use of the quiver 10 should now be apparent. Once the user has properly adjusted the pressure bar 38, it is an easy matter to put in or take out arrows 11 at will. Arrows 11 are placed in the quiver 10 starting with the arrowhead 12 being placed into the arrowhead housing 47 in such a manner that the shaft 13 falls under a flat pressure seat 39 and seats in the corresponding notch 37 in the shaft rest bar 35. When the shaft 13 is pressed into the corresponding aperture 28 of shaft grip bar 25 the resultant pressure on the arrow 11 from the pressure bar 38 will keep the arrow 11 forced into the notch 37. (The shaft 13 of the arrow 11 being flexible, it can withstand the pressure from a properly positioned pressure bar 38 without breaking or permanently deforming). To remove an arrow 11, the user reverses this sequence, first disengaging the shaft 13 of the arrow 11 from the shaft grip bar 25. This eases the pressure on the end of the arrow 11 near the arrowhead housing assembly 21. The curved indentations 40 facilitate the insertion or removal of the arrowhead 12 through the open end 30 of the arrowhead housing 47.

It should be apparent that the present invention relates to a quiver 10 which can either be hand held, attached to the bow, or otherwise carried by the user. The drawings indicate three mounting holes 45 in the frame 15 which allow the attachment of the quiver 10 to a bow. The mounting holes 45 may also be used to assemble the quiver 10 to a quick detachable bracket, thereby allowing for quick attachment and removal from a bow.

Figure 7:
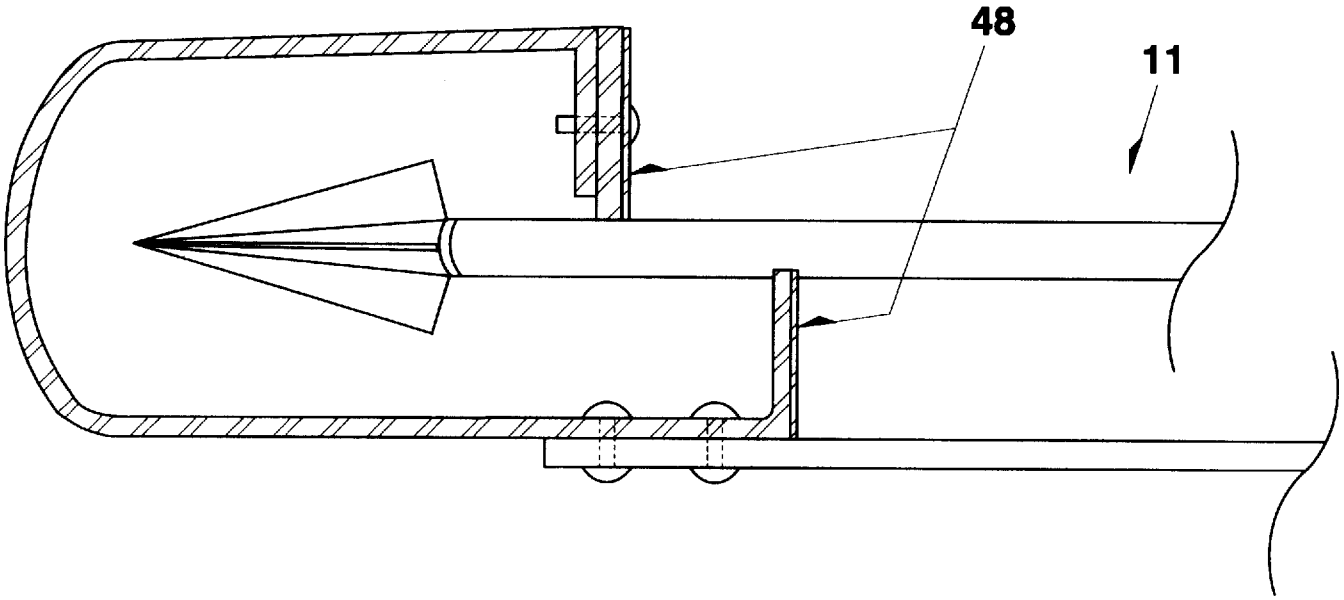
FIG. 7 is a sectional view similar to FIG. 4, but also showing the use of felt to quiet the removal of arrows.
Figure 8A:
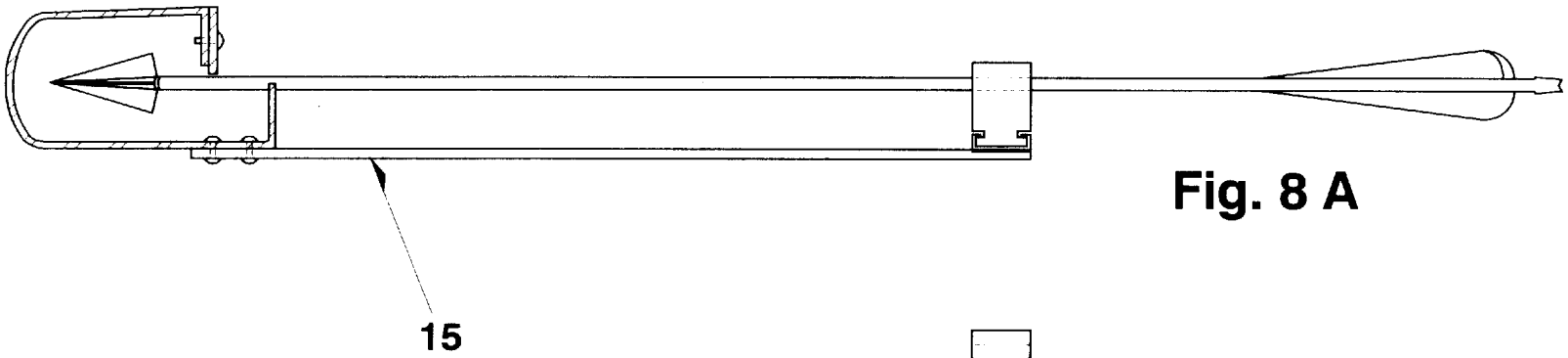
FIG. 8A is a simplified sectional view along line 6—6.
Figure 8B:
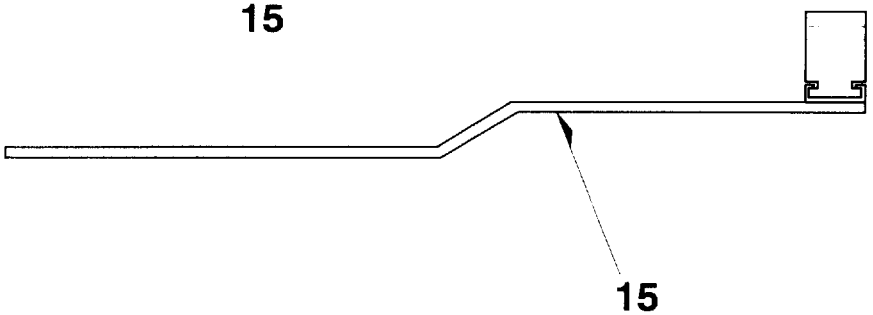
FIG. 8B shows another embodiment of the invention with an offset elongated base member.

It should also be apparent that the above description is illustrative only, and that many other embodiments of the invention can be described within the spirit and scope of this disclosure. In another embodiment of the invention, portions of the arrowhead housing 47 are lined with felt 48 or some other suitable material to deaden any noise caused by removal of the arrows 11. See FIG. 7. In another embodiment, the elongated frame 15 is not flat, but rather offset in the middle, thereby allowing the quiver 10 to be further removed from the bow to which it is secured. See FIGS. 8A and 8B. It should also be apparent that it would be possible to use a fixed, rather than an adjustable pressure bar 38 if it is known for certain that a particular size arrow 11 only will be used. Other embodiments of the frame 15 are also possible, such as providing suitable extensions at each end of the frame to provide additional supporting surface for the shaft grip assembly 20 and the arrowhead assembly 21.

What is claimed is:

1. A quiver for holding a plurality of arrows to be used by an archer comprising:

(a) an elongated frame;

(b) means for gripping the shaft of the arrows positioned at one end of the elongated frame;

(c) means for housing the arrowheads of the arrows positioned at the opposing end of the elongated frame;

(d) a shaft rest bar positioned intermediate the shaft gripping means, and the arrowhead housing means; and (e) pressuring means for putting pressure on the arrows so that the arrows are securely pressed against the rest bar.

2. A quiver for holding a plurality of arrows to be used by an archer comprising:

(a) an elongated frame;

(b) a shaft grip assembly positioned at one end of the elongated frame;

(c) an arrowhead housing assembly positioned at the opposing end of the elongated frame;

(d) a shaft rest bar positioned intermediate the shaft grip assembly and the arrowhead housing assembly; and (e) a pressure bar for exerting pressure on the shafts of arrows to be held in the quiver so that the arrows are securely pressed against the rest bar.

3. A quiver according to claim 2 wherein said shaft grip bar assembly includes a plurality of flexible tabs arrayed in opposing pairs to form partially enclosed apertures such that the shaft of an arrow may be inserted into an aperture by temporarily deforming the positioning of the flexible tabs, then held securely in place with the flexible tabs in their normal position, and then released by again temporarily deforming the positioning of the flexible tabs.

4. A quiver according to claim 2 wherein the shaft grip bar assembly includes a flanged base fixedly attached to the elongated frame and a shaft grip bar slidably and removably attached to said flanged base and including a plurality of flexible tabs arrayed in opposing pairs to form partially enclosed apertures for engaging and disengaging the shafts of arrows.

5. A quiver according to claim 2 wherein said arrowhead housing assembly includes a cupped member for receiving and protecting the arrowheads of the arrows to be held in the quiver.

6. A quiver according to claim 2 wherein said shaft rest bar includes a plurality of notches such that the shaft of an arrow to be held in the quiver will fit partially within a notch, thereby restricting its lateral motion.

7. A quiver according to claim 2 wherein the pressure bar is slidably and adjustably attached to the arrowhead housing assembly and positioned whereby it contacts the shafts of the arrows near where they enter the arrowhead housing assembly and exerts a pressure on them pushing them firmly against the shaft rest bar.

8. A quiver according to claim 7 wherein the pressure bar further includes a plurality of flat pressure seats in an alternating sequence with a plurality of indentations whereby pressure is exerted on the shaft of an arrow when it is positioned adjacent a flat pressure seat and said pressure is released when the shaft is moved into a neighboring indentation.

* * * * *